United States Patent [19]

Haruch et al.

[11] 4,349,156

[45] Sep. 14, 1982

[54] EFFICIENCY NOZZLE

[75] Inventors: James Haruch, Clarendon Hills; Robert Williams, Naperville, both of Ill.

[73] Assignee: Spraying Systems Company, Wheaton, Ill.

[21] Appl. No.: 177,087

[22] Filed: Aug. 11, 1980

[51] Int. Cl.[3] ..... B05B 7/04

[52] U.S. Cl. ..... 239/432

[58] Field of Search ..... 239/433, 434, 557, 565, 239/432, 428, 102, 407, 288

[56] References Cited

U.S. PATENT DOCUMENTS

| | | | |
|---|---|---|---|
| 3,251,556 | 5/1966 | Burnham | 239/433 |
| 3,413,385 | 11/1968 | Komac et al. | 239/433 |
| 4,024,025 | 5/1977 | Biss | 239/433 |

*Primary Examiner*—James B. Marbert

*Attorney, Agent, or Firm*—McWilliams, Mann & Zummer

[57] ABSTRACT

The invention comprises an atomizing spray nozzle having an expansion chamber containing an impingement plate, or table and wherein a flow of liquid is introduced as a high velocity stream which strikes the impingement table and breaks up into finely atomized particles which are struck by a high velocity air stream in a direction at an angle to the direction of the liquid stream to further atomize the liquid particles as the mixture atomizes adjacent the impingement table and passes into a mixing area in the barrel of the nozzle. The nozzle includes a jet forming inlet for the liquid aimed from one side of the nozzle at the impingement table in the expansion chamber, an air inlet orifice member secured in one end of the nozzle at an angle to the liquid inlet and at one side of the expansion chamber with the nozzle barrel at the downstream side of the expansion chamber and an exit orifice member secured in the open discharge end of the barrel.

7 Claims, 3 Drawing Figures

EFFICIENCY NOZZLE

BACKGROUND OF THE INVENTION

1. Field Of The Invention

Numerous spray nozzle designs are available in the prior art and represent the most versatile tools available to industry and agriculture that may be found today. The uses of such nozzles vary widely from crop spraying to snow making, to high impact washing, or gas scrubbing, or stack cooling, for example and these are but very few of the many uses to which such nozzles are related. The use of spray nozzles for various purposes is constantly growing and creates an ever increasing need for the energy required to operate the nozzles.

2 Description Of The Prior Art

The production of fine spray particles in prior practices has been by forcing the liquid through small slots, or orifices, at sufficiently high pressure to impart a swirling action, or turbulence to the liquid, to cause it to atomize into fine spray particles upon exiting from the nozzle. Another nozzle commonly used for atomizing, utilizes high pressure compressed air for the purpose of providing the mechanical energy to break up the particles and facilitate atomization, which is usually accomplished by directly impinging the air stream on the liquid. Both such methods in practice are uneconomical as practiced and very expensive, because large air compressors must be used and high pressure pumps of great capacity must be utilized in order to afford the capacities that are required for the efficient and effective scrubbing and cooling of the stack gases.

SUMMARY OF THE INVENTION

The atomizing nozzle of this invention is operated as a hydraulic nozzle using high velocity liquid assisted by the addition of high velocity air to achieve maximum spray particle break up and exceptionally fine atomization whereby to make the greatest utilization and efficient use of both such sources of power for operating the nozzle. This nozzle is operated in this air assisted manner and affords the most efficient nozzle, utilizing less compressed air and achieving finer atomization, than any nozzle known in the prior art which uses compressed air in relation to a liquid volume.

A unique feature of the present nozzle is the means utilized for air atomization which combines the liquid break up arrangements used in both pneumatic and hydraulic nozzles. The liquid is conditioned for air atomization by hydraulic forces which, normally, would atomize the liquid without the addition of pressurized air and at this sensitive point in the transition of the liquid flow within the confines of the nozzle, high velocity air is added and applied to the liquid in such manner as to take full advantage of the fluid instabilities and thereby further atomize the liquid to a much greater degree than would be possible utilizing hydraulics solely. This nozzle inherently has the ability to operate effectively with pressurized air and to use as much air as necessitated by the degree of atomization desired, from relatively coarse spray particle size to the very fine atomized spray particles provided by the added air atomization. This ability affords the most efficient utilization of both hydraulic and pneumatic energy by using a proper combination of high velocity air and liquid particularly adapted to making snow, as at ski resorts.

This atomizer nozzle arrangement includes a nozzle body that incorporates an air inlet and a liquid inlet.

One form of the invention provides a nozzle incorporating an expansion chamber where liquid enters from one side to impinge directly against an outstanding plate, or table, which thereby breaks up the liquid into atomized particles and to induce turbulence and further atomization of the liquid high velocity air is injected into the atomized liquid to create further atomization to effect efficient atomization followed by thorough mixture of the air and liquid in the barrel of the nozzle to provide a finely atomized mixture of the liquid with air just prior to reaching the discharge orifice of the nozzle.

In the preferred form of the nozzle a first chamber is defined in a side area of the nozzle body and is in communication with the liquid inlet orifice. An expansion chamber is disposed at least adjacent to this first chamber and includes an impingement plate, or table, within the expansion chamber. The orifice is defined in a side wall of the expansion chamber body to inject liquid from the orifice directly onto the impingement plate, or table, with very high velocity. An air inlet is disposed within the nozzle body and includes an inlet member threaded into the nozzle body at one end having an orifice in communication with expansion chamber.

The threaded inlet orifice member is secured into the nozzle body upstream from the expansion chamber and is disposed in a second chamber within the nozzle body having communication with high pressure air. The nozzle barrel is on the other side of the expansion chamber from this air inlet chamber so that with the liquid entering in the form of a high velocity jet from one side, to strike the impingement table and the high velocity air jet entering axially of the nozzle to strike the liquid over the impingement table, a finely atomized combining of the air and liquid is achieved which passes on into the nozzle barrel for further mixing prior to discharge through the exit orifice at this end of the nozzle. The exit orifice is formed in a separate cap member that is threaded into the discharge end of the nozzle. This enables the separate discharge cap member to be interchanged to provide orifices of different types. That shown comprises a flat spray type discharge but a round spray discharge may be obtained by installing that type of discharge cap in the nozzle body. It will be seen that the finely atomized spray discharged from this nozzle will freeze instantly in cold weather when the nozzle is utilized to form snow.

OBJECTS OF THE INVENTION

The primary purpose of the invention is the provision of a spray nozzle which can be operated by high velocity hydraulics assisted by a high velocity air jet, to achieve very fine atomization and obtain efficient utilization of the nozzle.

The principle object of the invention is the provision of a spray nozzle having a liquid inlet orifice and an air inlet orifice wherein an impingement table is disposed in the path of the incoming liquid and the incoming air strikes the liquid over the impingement table to provide a finely atomized mixture.

An important object of the invention is to provide a spray nozzle having an interior expansion chamber having an interior impingement table to destabilize a liquid jet and break it up into atomized droplets wherein the liquid enters the expansion chamber from a side and an air jet enters the expansion chamber from a direction extending generally axially of the nozzle and strikes the liquid over the table and the air and liquid passes into a mixing barrel beyond the expansion chamber prior to discharge from the nozzle.

A further object of this invention is the provision of an atomizing spray nozzle having a body containing an expansion chamber, an air inlet orifice secured in the body and discharging into the expansion chamber, an inlet orifice disposed in the nozzle at an angle to the air inlet orifice discharging liquid into the expansion chamber, an impingement table in the expansion chamber and a mixing barrel in the nozzle downstream from the expansion chamber.

A more specific object of the invention is to provide a spray nozzle assembly including a body having an expansion chamber, an air inlet chamber having an air inlet orifice member threaded into the body discharging into the expansion chamber, a liquid inlet chamber having an orifice discharging into the expansion chamber and an impingement table in the expansion chamber, with a liquid and air mixing barrel in the nozzle body beyond the expansion chamber and a discharge orifice from the mixing barrel for discharging a finely atomized spray from the nozzle.

Another specific object of this invention is to provide an atomizing nozzle having an interchangeable deflection cap for varying the type of spray discharged from the nozzle.

DESCRIPTION OF THE DRAWINGS

The foregoing and other and more specific objects of the invention are attained by the nozzle structure and arrangement illustrated in the accompaying drawings wherein.

DESCRIPTION OF PREFERRED EMBODIMENT

Figure 1:
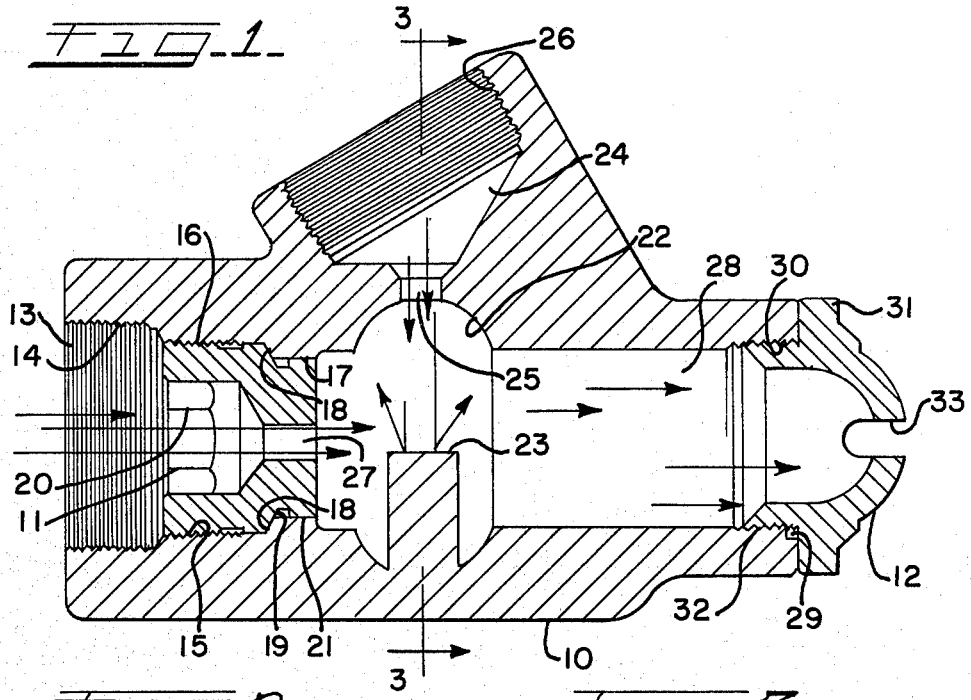
FIG. 1 is a general longitudinal sectional view through a preferred form of the atomizing spray nozzle showing an expansion chamber substantially centrally of the nozzle body with an impingement table in the chamber.
Figure 2:
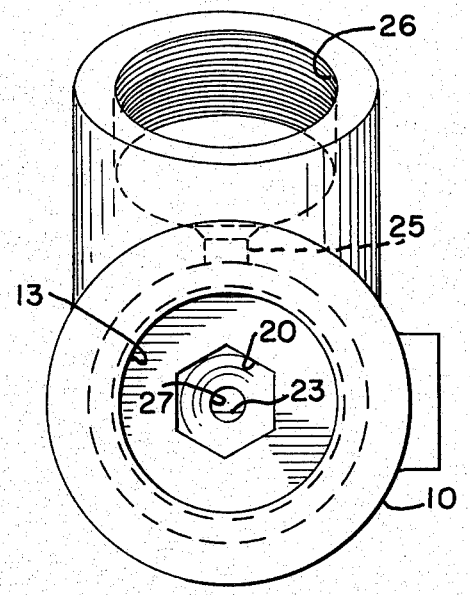
FIG. 2 is an end elevational view of the nozzle showing the nozzle with the air and liquid entrances.
Figure 3:
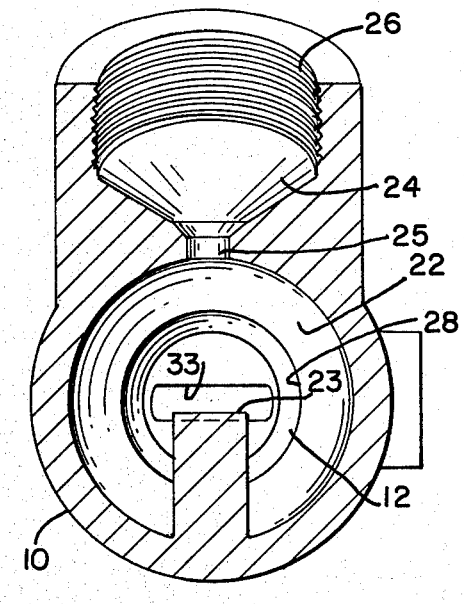
FIG. 3 is a transverse sectional view through the spray nozzle taken on the line 3—3 of FIG. 1.

The improved efficiency atomizing spray nozzle of this invention is illustrated in FIGS. 1 through 3 where it is readily seen that the entire nozzle assembly includes only three parts comprising a main nozzle body 10, a separate air inlet orifice member 11 and an exit orifice member 12. The nozzle main body 10 is provided with an air entrance opening 13 at one end and which is internally threaded as at 14 for the reception of an air line from a suitable source of compressed air (not shown).

A second threaded opening 15 at this end of the body 10 is provided for mounting the air inlet orifice member 11 which is threaded, as at 16, for securement in the opening 15. The opening 15 is of smaller diameter than the entrance opening 13 and a third opening 17 of still smaller diameter is provided in this area of the nozzle body and which includes a sloping seat 18 for an annular shoulder 19 on the air inlet member. The engagement of the shoulder 19 with the seat 18 provides a seal which is enhanced by the angularity of the surfaces.

The air inlet member is provided with an open hexagonal socket 20 for the insertion of a suitable tool to tighten the inlet unit into the threads 16 against the seat 18. The air inlet unit 11 also has an annular collar 21 having a close fitting engagement within the opening 17.

Intermediate the length of the nozzle body 10 a central expansion chamber 22 is provided for the effective mixing of a high velocity liquid stream and a pressurized high velocity air stream to provide an atomized mixture which is further atomized during subsequent processing through the nozzle. An impingement plate, or table 23, is provided in the interior of the expansion chamber providing a surface against which the incoming liquid impinges to form an unstable finely atomized series of liquid particles as it strikes the table and breaks up. The liquid enters the nozzle from a chamber 24 at one side of the nozzle body in the general area of the expansion chamber 22 through a liquid inlet, or orifice 25, which is provided from the chamber 24 to the expansion chamber 22. The chamber 24 is internally threaded as at 26 for the securement of a liquid supply line from a suitable source of liquid (not shown). This threaded inlet 26 leads to the liquid chamber 24 from which the liquid is supplied to the expansion chamber 22 through the orifice 25 in the form of a high pressure jet at high velocity. This high velocity jet aimed directly at the table 23 impinges on the table and splashes into an atomized spray. As best shown in FIG. 3, the orifice 25 is disposed in alignment with the impingement table 23 so that the liquid enters the expansion chamber whereby liquid discharged under pressure into the expansion chamber is immediately broken up by striking against the table 23 to obtain the greatest possible agitation and turbulence by this impingement of the liquid directly against the table 23.

An important feature of the invention is the manner in which air from the inlet member 11 is directed into the expansion chamber 22. The air inlet member is provided with a central orifice 27 directed axially into the expansion chamber 22 and adapted to blow across the surface of the table 23 and around the table striking the liquid particles splashing off of the table in a perpendicular relation thereto so that this high velocity air stream striking the liquid in this manner causes the liquid droplets to be further atomized and thoroughly mixed. This air and liquid mixture passes through the expansion chamber 22 into the barrel chamber 28 beyond the expansion chamber and which is downstream from the expansion chamber. The barrel 28 is of reduced diameter compared to the expansion chamber 22 and the air/liquid mixture is further mixed in traveling through this reduced area.

The nozzle barrel 28 is in axial alignment with the air entrance opening 13, the inlet 11 and the orifice 27 as well as the expansion chamber 22 so that incoming air travels through the nozzle in an axial direction to the discharge end of the nozzle. Pressurized air is discharged into the expansion chamber 22 at high velocity and high velocity liquid is injected at substantially 90° to each other through orifice openings 27 and 25 respectively so that with the air impinging into the liquid at the impingement table 23 an exceedingly active and thoroughly efficient mixing of the air and water is achieved with the greatest possible turbulence to achieve a thorough mixture suitable for atomizing in its subsequent passage through the nozzle barrel 28. The air is conducted through the air chamber 13 and transmitted perpendicularly against the unstable liquid in the expansion chamber through the right angle openings 27 and 25, both at high velocity, to create maximum agitation and turbulence.

It should be noted that the air orifice opening 27 is disposed longitudinally, or axially of the nozzle, while the liquid inlet orifice opening 25 is disposed transversely, or at an angle thereto so that mixing of the air and liquid occurs in the expansion chamber at the impingement table 23 without any possiblity of the air jet discharging directly through the nozzle without mixing into the liquid and in this way the most effective and efficient mixing of the two fluids is obtained. The air orifice 27 occupies a central position axially in the expansion chamber 22 so that with the liquid being injected into the expansion chamber from the orifice opening 25 and the air and liquid mixing and atomizing at the impingement table 23, the liquid is thoroughly and completely intermingled and mixed with air to provide a desired mixture for passage into the barrel 28 which leads to the discharge opening from the nozzle.

It is important to recognize that the liquid inlet orifice 25 and the air inlet orifice 27, while illustrated in the drawings as being round, may take any shape preferred to achieve the results desired in the turbulent mixing of the air and liquid streams entering the expansion chamber 22. One, or both of the inlets may be elongaged in directions to take full advantage of the intermingling relationship of the streams at the surface of the table 23. The orifice 25 might be elongated transversely of the nozzle to provide an elongated, or flat jet striking the full width of the table surface. The orifice 27 might be elongated in a direction parallel to the surface of the table 23 whereby to provide a full width jet of flat form to mix with the full width of the liquid jet from the orifice 25 and thereby obtain the greatest turbulence of the mixing streams. However, the orifices 25 and 27 might be elongated in other directions to obtain an expected result, or they might take any other shape to obtain a predetermined type of mixing of the air and liquid streams entering the chamber 22.

The nozzle barrel 28 terminates in a discharge opening 29 which is internally threaded as at 30. In the form disclosed a separate discharge orifice member, or cap 12 is utilized and this is provided with threads 32 which are threaded into the nozzle threads 30. Thus, the orifice cap is removable and interchangeable with caps having orifices of the desired type. The orifice cap 12 is provided with a flange 31 which abuts the end of the nozzle body 10 around the discharge opening 29 to provide a tight engagement when the cap is mounted in the nozzle opening.

A flat spray type orifice is illustrated in the nozzle as shown in FIG. 1 and while the discharge orifice might be incorporated as an integral part of the nozzle body, it preferably is formed as a separate element containing the orifice 33 and which is screwed into the nozzle body as indicated. The discharge orifice 33 is in the form of a slotted opening that causes the discharge to issue in a flat spray that makes the nozzle particularly adaptable to the making of snow. The nozzle is of high flow capacity and this contributes also to its advantageous use in the production of snow.

The nozzle body as described, is internally threaded and the discharge orifice member 12 is formed as a separate element which may be called an orifice cap that is threaded into the threads 30 to secure the discharge element in the nozzle body. The orifice member 12 is provided with the discharge orifice 33 that is elongated thus affording an advantageous flat spray pattern discharged from the nozzle. By threading the orifice element 12 into the nozzle body the orifice becomes interchangeable with other elements incorporating orifices of effectively different spray pattern capabilities, whereby the nozzle may readily be adapted to any of various conditions. For instance, the member 12 may be designed to provide a narrow round spray upon discharge to atmosphere. For this purpose the orifice 33 would be round so that the spray discharged will issue in a round pattern. The spray may be discharged in a flat fan pattern, or a narrow angled round spray pattern, which may be regulated by the type of orifice exit control utilized at the discharge exit orifice. When this nozzle is utilized for making snow the chosen spray pattern exits from the nozzle orifice 33 and freezes immediately into minute ice crystals for spraying onto a ski slope, or run.

The passage of air axially into the nozzle and through an orifice at high velocity into the expansion chamber to strike the entering liquid at high velocity over the impingement table and then into the nozzle barrel results in a more efficient operation of the nozzle in developing a finely atomized mixture for discharge from the nozzle outlet orifice and actually requires less energy in the amount of compressed air required to achieve a degree of atomization not attained by any other spray nozzle now available. A highly turbulent mixing of the air and liquid is achieved especially as a result of the impingement through which the mixture must engage and pass which creates the greatest possible improvement in the atomization of the mixture. The assembled parts of the nozzle provide an entity wherein all of the parts thereof are in axial alignment and function to cooperate fully in the attainment of the ultimate goal of providing an operative nozzle that acts as an integrated whole.

An important feature of the invention is the method utilized for adding air to further atomize the liquid which has been atomized and broken down into particles, or droplets, at the impingement table where the liquid break-up occurs initially followed by the high velocity mixing of air and liquid which is then further mixed in the nozzle barrel. In operation of the nozzle the liquid is first conditioned for atomization by impingement on the table 23 which would normally atomize the liquid even though no air was supplied. This represents a highly sensitive point of transitional liquid flow within the confines of the expansion chamber and when high velocity air is supplied at this point, in a manner to take full advantage of the fluids instabilities, the liquid will be further atomized to a far greater degree than either air or liquid pressure would be capable of accomplishing if used alone.

During the combined air and liquid operation the air from the inlet 13 is conducted through the center orifice 27, and enters the expansion chamber 22 through the angularly directed high velocity stream of liquid from orifice opening 25 at the very high velocity resulting from combining the high velocity air and liquid streams.

The very high velocity thus creates a great amount of turbulence and violently forceful mixing of the air with the liquid. This air and liquid mixture passes from the expansion chamber into the barrel 28 and thence to the discharge orifice 33. The degree of atomization and therefore the efficiency of this nozzle is determined by a particular volume of air at a particular liquid flow rate according to the ratio of the air inlet area to the exit orifice area where the size of the liquid inlet will determine the velocity at which the liquid stream will strike the impingement table at the particular rate of flow.

CONCLUSION

From the foregoing it will be seen that a highly efficient nozzle has been provided wherein atomization to a very high degree is obtained by impinging a high velocity stream of liquid against an impingement table in an expansion chamber and directing a high velocity stream of air into the impinged liquid at the table from a direction at an angle thereto and then further mixed and atomized in a reduced area barrel beyond the expansion chamber for subsequent discharge to atmosphere.

What is claimed is:

1. A high efficiency nozzle including a nozzle body having a high velocity air inlet opening and a high velocity liquid inlet opening, said air inlet opening directing incoming air axially of the nozzle substantially in a direction straight through the nozzle and said liquid inlet opening directing incoming liquid in a direction substantially at a right angle to the straight through direction of the incoming air, an expansion chamber in the nozzle body, an impingement table defining a flat surface in the expansion chamber, said flat surface disposed in a plane perpendicular to the axis of the liquid inlet opening, said liquid inlet opening including an orifice in alignment with said impingement table, said air inlet opening including an orifice disposed at substantially a right angle to said liquid inlet orifice and generally parallel to the impingement surface of said table, said air inlet opening being disposed at one side of said expansion chamber and a nozzle barrel at the opposite side of said chamber whereby high velocity air is directed across said impingement table to finely atomize liquid particles and the finely atomized liquid particles are carried straight through said nozzle barrel by said high velocity air.

2. A high efficiency nozzle as set forth in claim 1 wherein said air inlet opening is disposed at one side of said expansion chamber, and a nozzle barrel of reduced area at the opposite side of said chamber.

3. A high efficiency nozzle as set forth in claim 2 wherein said air inlet opening is disposed at one end extending axially of the nozzle and said liquid inlet opening is disposed at one side extending transversely of the nozzle.

4. A high efficiency nozzle as set forth in claim 3 wherein the nozzle includes a separate orifice member secured in said air inlet opening, and a discharge orifice cap secured in the end of said barrel.

5. A high efficiency nozzle as set forth in claim 4 wherein liquid injected into the expansion chamber strikes said table to break into particles, air injected into the expansion chamber strikes said particles over the table to atomize the liquid, and the air and liquid passing into said barrel for further mixing prior to emission through said discharge orifice.

6. A high efficiency nozzle as set forth in claim 2 wherein said air inlet opening is elongated in a direction parallel to the surface of said table, and said liquid inlet opening is elongated in a direction transversely of said nozzle.

7. A high efficiency nozzle as set forth in claim 5 wherein the air inlet orifice and the liquid inlet orifice are both of elongated shape to direct air and liquid streams relative to said table in substantially flat form.

* * * * *